US008092974B2

(12) United States Patent
Kurokawa et al.

(10) Patent No.: US 8,092,974 B2
(45) Date of Patent: Jan. 10, 2012

(54) PRODUCTION METHOD OF TONER FOR DEVELOPING ELECTROSTATIC IMAGE

(75) Inventors: Hisashi Kurokawa, Tokyo (JP); Michito Horie, Tokyo (JP)

(73) Assignee: Zeon Corporation, Tokyo (JP)

( * ) Notice: Subject to any disclaimer, the term of this patent is extended or adjusted under 35 U.S.C. 154(b) by 1139 days.

(21) Appl. No.: 11/905,155

(22) Filed: Sep. 27, 2007

(65) Prior Publication Data

US 2008/0085461 A1 Apr. 10, 2008

(30) Foreign Application Priority Data

Sep. 29, 2006 (JP) ..... 2006-267108
Dec. 21, 2006 (JP) ..... 2006-344424

(51) Int. Cl.
*G03G 9/087* (2006.01)

(52) U.S. Cl. ..... 430/137.17; 430/137.15
(58) Field of Classification Search ..... 430/137.15, 430/137.17
See application file for complete search history.

(56) References Cited

U.S. PATENT DOCUMENTS 6,346,356 B1 * 2/2002 Ohno et al. ..... 430/108.2
2005/0196691 A1 * 9/2005 Ohtani et al. ..... 430/105

FOREIGN PATENT DOCUMENTS

JP 2006-184686 * 7/2006
WO WO 2006/013847 A1 2/2006

OTHER PUBLICATIONS

Translation of JP 2006-184686 published Jul. 2006.*

* cited by examiner

*Primary Examiner* — Peter Vajda
(74) *Attorney, Agent, or Firm* — Westerman, Hattori, Daniels & Adrian, LLP

(57) ABSTRACT

A production method of a toner includes a suspension process in which a polymerizable monomer composition is dispersed in an aqueous dispersion medium; and a polymerization process in which suspension polymerization is performed with the suspension in the presence of a polymerization initiator to obtain colored resin particles. In the suspension process an inhibitor of small diameter microparticle production is contained in the aqueous dispersion medium. A minimum reaction activation energy $E_{min}$ of the inhibitor of small diameter microparticle production is 7 kcal/mol or less and an octanol-water partition coefficient log P is 2 or less. The minimum reaction activation energy $E_{min}$ is a minimum value of a reaction activation energy "E" which is required when a phenylpropane radical represented by the following Formula 1 acts on the inhibitor of small diameter microparticle production:

Formula 1:

11 Claims, 3 Drawing Sheets

PRODUCTION METHOD OF TONER FOR DEVELOPING ELECTROSTATIC IMAGE

BACKGROUND OF THE INVENTION

1. Field of the Invention

The present invention relates to a production method of a toner for developing an electrostatic latent image used for development of an electrostatic image in an electrophotography, an electrostatic recording method, an electrostatic printing process or the like (hereinafter, it may be simply referred to as "a toner"). Particularly, the present invention relates to a production method of a toner for developing an electrostatic image which is excellent in productivity in production and shelf stability at high temperature, and produces no odor when printing using the same.

2. Description of the Related Art

Recently, the need of colorization of printed images for image-forming devices employing the electrophotography method such as copying machines, facsimiles, printers or the like is increasing. Since in color printing, a precise image requiring reproduction of a clear color tone such as a photograph or the like is also printed, high resolution is necessary. Accordingly, a colored toner which can suffice such requirements is demanded.

Attaining both excellent transferability and dot reproducibility thereby increases resolution of an image so as to obtain excellent printing performance. To obtain such a printing performance, a spherical toner with a small particle diameter is suitable. As a method of producing such a toner, a polymerization method is proposed. In a pulverization method, which is a conventional method to produce a toner, a shape of the toner thus produced is irregular. In addition, production of a toner with a small particle diameter involves a decrease in yield and large energy consumption for pulverization. To the contrary, in a polymerization method, yield is high and energy consumption is low since a pulverization process is not required. Further, a spherical toner can be easily produced.

As a method of producing a toner by the polymerization method, there may be a suspension polymerization method, an emulsion agglomeration polymerization method, a dispersion polymerization method, and so on. In the suspension polymerization method, firstly, a polymerizable monomer, a colorant, and if required, other additives are mixed to prepare a polymerizable monomer composition, and the polymerizable monomer composition is dispersed in an aqueous dispersion medium containing a dispersion stabilizer. Next, high shear is applied to the aqueous dispersion medium having the polymerizable monomer composition dispersed by means of a high-speed agitator or the like to form droplets of the polymerizable monomer composition. Then, the aqueous dispersion medium having the droplets of the polymerizable monomer composition dispersed is polymerized in the presence of a polymerization initiator followed by removal of the dispersion stabilizer, washing, filtering, dehydrating and drying, thus, colored resin particles are obtained. Further, the colored resin particles are mixed with an external additive such as an inorganic fine particle or the like to obtain a polymerized toner. Further, if required, the polymerized toner is mixed with a carrier to obtain a two-component developer.

As aforementioned, compared to the conventional pulverization method, obtaining the colored resin particles by the polymerization method has big advantages that spherical colored resin particles with a small particle diameter can be formed in the stage of forming particles (in the polymerization method, in a stage of forming droplets and polymerizing) and a particle size distribution can be controlled to be narrower. However, with the recent increasing demand for image printing with high resolution and high image quality, it is attempted to decrease the diameter of toner particles. In addition, a new problem is found in the polymerized toner.

The problem is described as follows: in a polymerization process of a production method of a toner, besides desired colored resin particles, undesired particles with a very small particle diameter are produced as a by-product. They affect production efficiency and printing performance of the toner.

As the by-product microparticles, there may be mainly microparticles with a diameter of less than 0.6 μm (or with a so-called submicron order particle diameter) and containing no colorant (hereinafter, such microparticles are referred to as "small diameter microparticles").

If such small diameter microparticles are produced as a by-product, a part of the microparticles released clogs a filter upon filtration of the obtained colored resin particles from an aqueous dispersion medium. A filtration rate thereby decreases so as to reduce the production efficiency of a toner.

Moreover, if a polymerized toner containing a lot of small diameter microparticles is used for image forming, since the small diameter microparticles have high adherence, they are likely to adhere to members in a developing system. Consequently, the attached small diameter microparticles are gradually accumulated so as to cause filming (adherence) to the members when plural prints are printed using the polymerized toner. For example, when the microparticles cause filming on a photosensitive member in the developing system, a surface of the photosensitive member is poorly charged and a desired electrostatic latent image cannot be formed on the photosensitive member. As a result, problems such as generation of a fog on a recording medium and so on are caused, which result in that no excellent image is obtained and printing performance of the toner including printing durability and so on may be reduced.

According to the polymerization method, for example, colored resin particles with a volume average particle diameter "Dv" of from about 3 to 15 μm can be readily formed. However, separation of the colored resin particles with a desired particle diameter and undesired small diameter microparticles becomes difficult since a targeted particle diameter range comes closer to the above-mentioned particle diameter of the small diameter microparticles as it shifts to a small particle diameter side. Thus, development of a production method which is capable of inhibiting production of by-product small diameter microparticles, and excellent in printing performance and production efficiency of a toner is desired.

In order to meet such demands, various approaches and insights are provided to a method of inhibiting the production of by-product small diameter microparticles.

For example, PCT International Publication Number WO 2006/013847 discloses a production method of a polymerized toner characterized in that: a polymerizable monomer composition containing a polymerizable monomer, a colorant and a charge control agent is charged into an aqueous dispersion medium and stirred; t-butylperoxy-2-ethylhexanoate (product name: PERBUTYL O; manufactured by: NOF Corporation) is added thereto as a polymerization initiator to form droplets; and a hydroquinone compound is added thereto as a water-soluble polymerization inhibitor (an inhibitor of small diameter microparticle production) before polymerization.

However, as a result of consideration by the inventors of the present invention, it is found that the hydroquinone compound used as an inhibitor of small diameter microparticle production in WO 2006/013847 is not fully effective in inhibiting the production of small diameter microparticles as a by-product.

Accordingly, an inhibitor of small diameter microparticle production which is more effective than the hydroquinone compound in inhibiting the production of by-product small diameter microparticles is desired.

SUMMARY OF THE INVENTION

The first object of the present invention is to provide a method of producing a toner for developing an electrostatic image, in which less small diameter microparticles are produced as a by-product in polymerization of toner so that washing is easy leading to excellent productivity, and shelf stability at high temperature (preventing aggregation of the toner during storage) is excellent. The second object of the present invention is to attain the first object and preferably further to provide a method of producing a toner for developing an electrostatic image, in which residual amounts of a degradation product of a polymerization initiator and so on remained in the toner are reduced so that less odor is produced leading to no environmental deterioration, and a shelf stability at high temperature is excellent.

As the result of diligent researches made to attain the above objects, the inventors of the present invention found out that specific parameters (a minimum reaction activation energy $E_{min}$ and an octanol/water partition coefficient logP) contribute to an inhibiting ability of small diameter microparticles, which is a property of an inhibitor of small diameter microparticle production. The inventors also found out that since it is possible to inhibit or stop the polymerization reaction of a polymerizable monomer (e.g. a radical monomer) dissolved (present) in an aqueous dispersion medium (an aqueous phase), which progresses in a polymerization process by selecting an inhibitor of small diameter microparticle production having the specified parameter and adding the inhibitor of a specific amount in the aqueous phase in a suspension process, it is possible to efficiently inhibit the production of by-product small diameter microparticles upon polymerization. Thus, the inventors of the present invention completed the present invention based on the above knowledge.

In particular, the production method of a toner for developing an electrostatic image of the present invention is a production method of a toner for developing an electrostatic image comprising steps of: a suspension process in which a polymerizable monomer composition comprising at least a polymerizable monomer and a colorant is dispersed in an aqueous dispersion medium comprising a dispersion stabilizer to obtain a suspension having droplets of the polymerizable monomer composition dispersed; and a polymerization process in which suspension polymerization is performed with the suspension in the presence of a polymerization initiator to obtain colored resin particles;

wherein, in the suspension process to obtain the suspension, an inhibitor of small diameter microparticle production of from 0.01 to 1 part by weight is contained in the aqueous dispersion medium with respect to the polymerizable monomer of 100 parts by weight;

wherein a minimum reaction activation energy $E_{min}$ of the inhibitor of small diameter microparticle production is 7 kcal/mol or less and an octanol/water partition coefficient logP is 2 or less; and wherein the minimum reaction activation energy $E_{min}$ is a minimum value of a reaction activation energy "E" which is required when a phenylpropane radical represented by the following Formula 1 acts on the inhibitor of small diameter microparticle production so as to withdraw a hydrogen of a phenolic hydroxyl group present in a molecular structure of the inhibitor of small diameter microparticle production followed by production of a radical:

Formula 1:

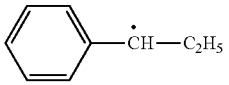

According to the production method of a toner for developing an electrostatic image of the present invention, a toner for developing an electrostatic image, in which washing is easy so that productivity is excellent since small diameter microparticles produced as a by-product in polymerization of the toner can be sufficiently inhibited, and a shelf stability at high temperature is excellent, can be obtained. Further, a toner for developing an electrostatic image, in which less odor is produced so that environment is not deteriorated since residual amounts of an unreacted polymerizable monomer (a remaining monomer) and a degradation product of a polymerization initiator remained in the toner can be reduced, and a shelf stability at high temperature is excellent, can be obtained.

BRIEF DESCRIPTION OF THE DRAWINGS

In the accompanying drawings.

Figure 1:
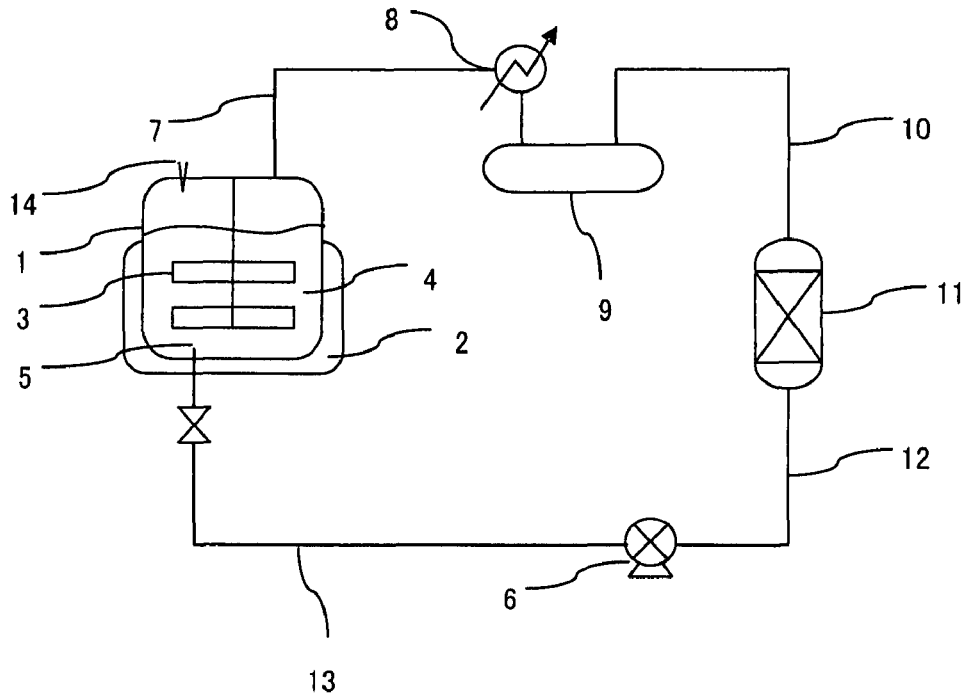
FIG. 1 is a view showing a system used in a stripping process employed in Examples of the present invention.

The sign in each figure refers to the following: 1. an evaporator; 2. a jacket; 3. an agitator with stirring vane; 4. an aqueous dispersion of colored resin particles 5. a gas blowing tube; 6. a blower; 7. a gas circulation line; 8. a condenser; 9. a condensation tank; 10. a gas circulation line; 11. a removal device for volatiles; 12. a gas circulation line; 13. a gas circulation line; and 14. a noncontact bubble level meter.

DETAILED DESCRIPTION OF THE INVENTION

The production method of a toner for developing an electrostatic image of the present invention is a production method of a toner for developing an electrostatic image comprising steps of: a suspension process in which a polymerizable monomer composition comprising at least a polymerizable monomer and a colorant is dispersed in an aqueous dispersion medium comprising a dispersion stabilizer to obtain a suspension having droplets of the polymerizable monomer composition dispersed; and a polymerization process in which suspension polymerization is performed with the suspension in the presence of a polymerization initiator to obtain colored resin particles;

wherein, in the suspension process to obtain a suspension, an inhibitor of small diameter microparticle production of from 0.01 to 1 part by weight is contained in the aqueous dispersion medium with respect to the polymerizable monomer of 100 parts by weight;

wherein a minimum reaction activation energy $E_{min}$ of the inhibitor of small diameter microparticle production is 7 kcal/mol or less and an octanol/water partition coefficient logP is 2 or less; and wherein the minimum reaction activation energy $E_{min}$ is a minimum value of a reaction activation energy "E" which is required when a phenylpropane radical represented by the following Formula 1 acts on the inhibitor of small diameter microparticle production so as to withdraw a hydrogen of a phenolic hydroxyl group present in a molecular structure of the inhibitor of small diameter microparticle production followed by production of a radical:

Formula 1:

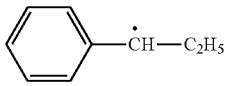

Hereinafter, the production method of a toner for developing an electrostatic image of the present invention will be described.

(1) Suspension Process of Obtaining a Suspension (Droplets Forming Process)

A suspension process, in which a polymerizable monomer composition comprising at least a polymerizable monomer and a colorant is dispersed in an aqueous dispersion medium comprising a dispersion stabilizer to obtain a suspension having droplets of the polymerizable monomer composition dispersed, includes "(1-1) Preparation process of polymerizable monomer composition" and "(1-2) Suspension process of obtaining suspension (droplets forming process)". A desired suspension can be obtained after going through the above-mentioned processes.

Herein, "to suspend" means to form droplets of a polymerizable monomer composition in an aqueous dispersion medium.

(1-1) Preparation Process of Polymerizable Monomer Composition

Firstly, a polymerizable monomer, a colorant, and if required, a charge control agent or other additives are mixed together to prepare a polymerizable monomer composition. Mixing upon the preparation of the polymerizable monomer composition may be performed, for example, by means of a media type dispersing machine.

In the present invention, a polymerizable monomer means a compound which can be polymerized. As a main component of the polymerizable monomer, a monovinyl monomer is preferably used. As the monovinyl monomer, for example, there may be styrene; a styrene derivative such as vinyl toluene, α-methylstyrene or the like; acrylic acid and methacrylic acid; acrylic acid ester such as methyl acrylate, ethyl acrylate, propyl acrylate, butyl acrylate, 2-ethyl hexyl acrylate, dimethylaminoethyl acrylate or the like; methacrylic acid ester such as methyl methacrylate, ethyl methacrylate, propyl methacrylate, butyl methacrylate, 2-ethyl hexyl methacrylate, dimethylaminoethyl methacrylate or the like; an amide compound such as acrylamide, methacrylamide or the like; olefin such as ethylene, propylene, butylene or the like; and so on. The monovinyl monomers may be used alone or in combination. Among them, stylene, a stylene derivative, an acrylic acid derivative or methacrylic acid derivative is suitably used as the monovinyl monomer.

In order to prevent hot offset, as a part of the polymerizable monomer, any crosslinkable polymerizable monomer may be preferably used together with the monovinyl monomer. The crosslinkable polymerizable monomer means a monomer having two or more polymerizable functional groups. As the crosslinkable polymerizable monomer, for example, there may be an aromatic divinyl compound such as divinyl benzene, divinyl naphthalene, a derivative thereof or the like; unsaturated carboxylic acid polyester of polyalcohol such as ethylene glycol dimethacrylate, diethylene glycol dimethacrylate or the like; a divinyl compound other than the above such as N,N-divinyl aniline, divinyl ether or the like; a compound having three or more vinyl groups such as trimethylolpropane trimethacrylate, dimethylolpropane tetraacrylate or the like; and so on. The crosslinkable polymerizable monomers may be used alone or in combination of two or more kinds.

In the present invention, the crosslinkable polymerizable monomers may be desirably used in an amount in the range of generally from 0.1 to 5 parts by weight, preferably from 0.3 to 2 parts by weight, with respect to the monovinyl monomer of 100 parts by weight.

Further, as a part of the polymerizable monomer, any macromonomer may be preferably used together with the monovinyl monomer so that shelf stability and fixing ability at low temperature of the toner can be well-balanced. The macromonomer is a reactive oligomer or polymer which has a polymerizable carbon-carbon unsaturated double bond at the end of a polymer chain and a number average molecular weight of from 1,000 to 30,000 generally. As the macromonomer, a macromonomer which provides a polymer having higher "Tg" (glass transition temperature) than that of a polymer obtained by polymerization of the monovinyl monomer is preferable.

In the present invention, an amount of the macromonomer desirably used may be generally in the range from 0.01 to 10 parts by weight, preferably from 0.03 to 5 parts by weight, more preferably from 0.05 to 1 part by weight, with respect to the monovinyl monomer of 100 parts by weight.

A colorant is used in the present invention. To produce a colored toner, in which four types of toners including a black toner, a cyan toner, a yellow toner and a magenta toner are generally used, a black colorant, a cyan colorant, a yellow colorant and a magenta colorant may be respectively used.

In the present invention, as the black colorant, carbon black, titanium black, a magnetic powder such as zinc-ferric oxide, nickel-ferric oxide or the like may be used.

As the cyan colorant, for example, a compound such as a copper phthalocyanine pigment, a derivative thereof, an anthraquinone pigment or the like may be used. Specifically, there may be C. I. Pigment Blue 2, 3, 6, 15, 15:1, 15:2, 15:3, 15:4, 16, 17:1, 60 or the like. For good stability in polymerization and tinting strength of a toner obtained, the copper phthalocyanine pigment such as C. I. Pigment Blue 15, 15:1, 15:2, 15:3, 15:4, 17:1, or the like is preferable, and C. I. Pigment Blue 15:3 is more preferable.

As the yellow colorant, for example, a compound including an azo pigment such as a monoazo pigment, a disazo pigment or the like, a condensed polycyclic pigment and so on may be used. Specifically, there may be C. I. Pigment Yellow 3, 12, 13, 14, 15, 17, 62, 65, 73, 74, 83, 93, 97, 120, 138, 155, 180, 181, 185, 186, 213 or the like.

As the magenta colorant, for example, a compound including an azo pigment such as a monoazo pigment, a disazo pigment or the like, a condensed polycyclic pigment and so on may be used. Specifically, there may be C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 or 251, C. I. Pigment Violet 19 or the like. For good stability in polymerization and tinting strength of a toner thus obtained, a monoazo pigment such as C. I. Pigment Red 31, 48, 57:1, 58, 60, 63, 64, 68, 112, 114, 146, 150, 163, 170, 185, 187, 206, 207 or the like may be preferable.

In the present invention, the colorants may be used alone or in combination of two or more kinds. An amount of the colorants desirably used may be preferably in the range from 1 to 10 parts by weight with respect to the monovinyl monomer of 100 parts by weight.

As one of said other additives, a charge control agent may be preferably used. As the charge control agent, various kinds of charge control agents having positively charging ability or negatively charging ability may be used. For example, there may be a charge control agent which is not resin such as a metallic complex of an organic compound having a carboxyl group or a nitrogen-containing group, a metal-containing dye, nigrosine or the like; a charge control resin such as a quaternary ammonium base containing copolymer, a sulfonic acid group or sulfonate structure containing copolymer, a carboxyl group or carboxylate structure containing copolymer, or the like. Among them, since it provides excellent printing durability for the toner, the charge control agent may preferably contain the charge control resin. Among the charge control agents, the non-resin charge control agent and the charge control agent may be used in combination or the charge control resin may be used alone. It is more preferable to use the charge control resin alone. It is further preferable to use the quaternary ammonium base containing copolymer as the charge control resin.

In the present invention, an amount the charge control agent desirably used may be generally in the range of from 0.01 to 10 parts by weight, preferably from 0.03 to 8 parts by weight, with respect to the monovinyl monomer of 100 parts by weight.

As one of said other additives, a release agent may be preferably added since it can improve a releasing characteristic of the toner from a fixing roller at fixing. As the release agent, one which is generally used as a release agent for the toner may be used without any particular limitation. There may be a polyolefin wax such as low-molecular-weight polyethylene, low-molecular-weight polypropylene, low-molecular-weight polybutylene or the like; a natural wax such as candelilla, a carnaubawax, a rice wax, a haze wax, jojoba or the like; a petroleum wax such as paraffin, microcrystalline, petrolactam or the like; a mineral wax such as montan, ceresin, ozokerite or the like; a synthesized wax such as a Fischer-Tropsch wax or the like; an esterified compound of polyalcohol including pentaerythritol ester such as pentaerythritol tetramyristate, pentaerythritol tetrapalmitate, pentaerythritol tetrastearate, pentaerythritol tetralaurate or the like, dipentaerythritol ester such as dipentaerythritol hexamyristate, dipentaerythritol hexapalmitate, dipentaerythritol hexylaurate or the like; and so on. Among them, the esterified compound of polyalcohol is preferable since it can improve the low-temperature fixing ability of the toner and cannot deteriorate printing durability. The esterified compounds may be used alone or in combination of two or more kinds.

In the present invention, an amount of the release agent desirably used may be generally in the range from 0.1 to 30 parts by weight, preferably from 1 to 20 parts by weight, with respect to the monovinyl monomer of 100 parts by weight.

As one of said other additives, a molecular weight modifier may be preferably used. As the molecular weight modifier, there may be mercaptans such as t-dodecyl mercaptan, n-dodecyl mercaptan, n-octyl mercaptan, 2,2,4,6,6-pentamethylheptane-4-thiol or the like; thiuram disulfides such as tetramethyl thiuram disulfide, tetraethyl thiuram disulfide, tetrabutyl thiuram disulfide, N,N'-dimethyl-N,N'-diphenyl thiuram disulfide, N,N'-dioctadecyl-N,N'-diisopropyl thiuram disulfide 11 or the like; and so on. The molecular weight modifier may be added prior to or during polymerization.

In the present invention, an amount of the molecular weight modifier desirably used may be generally in the range from 0.01 to 10 parts by weight, preferably from 0.1 to 5 parts by weight, with respect to the monovinyl monomer of 100 parts by weight.

(1-2) Suspension Process of Obtaining Suspension (Droplets Forming Process)

The polymerizable monomer composition thus obtained in "(1-1) Preparation process of polymerizable monomer composition" is dispersed in an aqueous dispersion medium comprising a dispersion stabilizer. After addition of a polymerization initiator, droplets of the polymerizable monomer composition are formed. The method of forming droplets may not be particularly limited. For example, droplets may be formed by means of a device capable of high dispersion such as MILDER MDN303V (product name; manufactured by: Pacific Machinery & Engineering Co., Ltd) as an in-line type emulsifying and dispersing machine, T. K. HOMOMIXER MARK II (product name; manufactured by PRIMIX Corporation) as a high-speed emulsification dispersing machine, CAVITRON CD 1000 (product name; manufactured by Pacific Machinery & Engineering Co., Ltd) or the like.

In this process, as the inhibitor of small diameter microparticle production, an inhibitor of small diameter microparticle production having specific parameters to be described hereinafter is selected and added in the aqueous dispersion medium (the aqueous phase) in a specific amount.

The inhibitor of small diameter microparticle production selected in the present invention has an ability to trap a radical, namely, a radical trapping ability, which is normally desired not to be present in an aqueous dispersion medium (an aqueous phase) but is actually dissolved in the aqueous phase. Such a radical is a radical derived from a polymerization initiator or a radical derived from a polymerizable monomer to which the radical derived from the polymerization initiator is added.

In the present invention, the radical trapping ability of the inhibitor of small diameter microparticle production means: 1) an ability of a hydrogen of a phenolic hydroxyl group present in a molecular structure of the inhibitor of small diameter microparticle production, which is withdrawn by the attack of a radical in an aqueous phase, to eliminate the radical attacked in the aqueous phase and 2) an ability of a radical of the inhibitor of small diameter microparticle production, which is produced in such a manner that a radical in an aqueous phase withdraws a hydrogen of a phenolic hydroxyl group, to eliminate the radical by bonding to other radicals in the aqueous phase.

A minimum reaction activation energy $E_{min}$ of the inhibitor of small diameter microparticle production used in the present invention is 7 kcal/mol or less, more preferably 6 kcal/mol or less, still more preferably 5 kcal/mol or less.

By selecting an inhibitor of small diameter microparticle production having a minimum reaction activation energy $E_{min}$ as small as possible as mentioned above with the specific minimum reaction activation energy $E_{min}$, radical production of the inhibitor of small diameter microparticle production becomes easy and the radical trapping ability of the inhibitor increases. Consequently, the inhibitor of small diameter microparticle production can readily trap a radical of a polymerizable monomer dissolved in an aqueous dispersion medium (an aqueous phase), which is, for example, a radical monomer, and can inhibit (or stop) the polymerization reaction of the polymerizable monomer. Thus, production of by-product small diameter microparticles can be efficiently inhibited in polymerization.

When using an inhibitor of small diameter microparticle production having a minimum reaction activation energy $E_{min}$ which exceeds the above range, radical production of the inhibitor of small diameter microparticle production becomes difficult and the radical trapping ability of the inhibitor decreases. Consequently, the inhibitor of small diameter microparticle production can hardly trap the radical of the polymerizable monomer dissolved in the aqueous dispersion medium (the aqueous phase), for example, a radical monomer, and cannot inhibit (or stop) the polymerization reaction of the polymerizable monomer. Thus, production of by-product small diameter microparticles may not be inhibited in polymerization.

In the present invention, "minimum reaction activation energy $E_{min}$" means a minimum value of the energy required for radical production among the energy necessary for radical production (a reaction activation energy "E") in the process wherein plurality of hydrogens of phenolic hydroxyl groups present in the molecular structure of the inhibitor of small diameter microparticle production are withdrawn by a phenylpropane radical represented by the following Formula 1 to produce a radical of the inhibitor of small diameter microparticle production. This minimum reaction activation energy $E_{min}$ shows the easiness of occurrence of the radical production of the inhibitor of small diameter microparticle production and is used as an indicator of capability of the radical trapping ability of the inhibitor.

Formula 1:

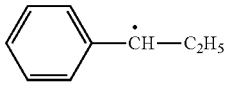

In the present invention, the reason of using the phenylpropane radical for calculation of the reaction activation energy "E" is as follows.

Since the molecular structure of the phenylpropane radical is similar to that of an end of a radical derived from a polymerizable monomer produced from a styrene, which is one of the polymerizable monomers preferably used in the present invention, by the action of a radical derived from the polymerization initiator, it is presumed to be easy to estimate the level of radical trapping ability performed by the inhibitor of small diameter microparticle production in the actual aqueous phase by referring to a minimum reaction activation energy $E_{min}$ when the hydrogen of the phenolic hydroxyl group present in the molecular structure of the inhibitor is withdrawn by the attack of the phenylpropane radical.

In the present invention, the reaction activation energy "E" is a calculated value obtained from a molecular structure of a chemical substance by using a computational chemistry approach.

Specifically, in the computational chemistry approach, calculation is conducted by an ab initio molecular orbital method based on a density functional theory (DFT) for evaluation. In the molecular orbital calculation, Blyp is used as a functional and DND is used as a basis function. As a molecular orbital calculation software, Dmo13 (product name; manufactured by: Accelrys Software Inc.) is used for calculation.

An octanol/water partition coefficient logP of the inhibitor of small diameter microparticle production used in the present invention is preferably 2 or less, more preferably from −3 to 1, still more preferably from −2 to 0.

When there is a range of calculated values for the octanol/water partition coefficient logP specified in the present invention, a center value thereof is referred to as the octanol/water partition coefficient logP.

By selecting the inhibitor of small diameter microparticle production having the octanol/water partition coefficient logP in the above range, compatibility (solubility) of the inhibitor of small diameter microparticle production with the aqueous dispersion medium (the aqueous phase) becomes appropriate and the inhibitor can be present in the aqueous dispersion medium (the aqueous phase) so that the inhibitor can fully exhibit the effect of inhibiting the production of by-product small diameter microparticles in the aqueous dispersion medium.

Also, when the octanol/water partition coefficient logP of the inhibitor of small diameter microparticle production used in the present invention exceeds the above range, compatibility (solubility) of the inhibitor of small diameter microparticle production with the aqueous dispersion medium (the aqueous phase) becomes inferior so that the inhibitor may not fully exhibit the effect of inhibiting the production of by-product small diameter microparticles in the aqueous dispersion medium.

The octanol/water partition coefficient is an indicator of the extent of distribution of a chemical substance between an octanol phase and an aqueous phase, and defined as the following Calculation formula 1:

Calculation Formula 1:

$$\log P = \log\left(\frac{\text{molar concentration of chemical in octanol phase}}{\text{molar concentration of chemical in aqueous phase}}\right)$$

As the value of logP obtained by the Calculation formula 1 increases, the hydrophobicity of the chemical substance becomes higher. As the value of logP decreases, the hydrophilicity of the chemical substance becomes higher. For example, a chemical substance with logP of 0 or less is liable to be dissolved in an aqueous phase rather than in an octanol phase, and a chemical substance with logP of 1 has solubility in the octanol phase ten times higher than that in the aqueous phase.

Generally, the octanol/water partition coefficient logP can be obtained by actual measurement with the use of n-octanol and water. In the present invention, however, the octanol-water partition coefficient logP is a calculated value obtained from a molecular structure of a compound by a computational chemistry approach.

Specifically, as the computational chemistry approach, ACD/LogP DB of Advanced Chemistry Development Inc. was used for calculation.

In the computational chemistry approach, a metal having no parameter is replaced with hydrogen in calculation.

A content of the inhibitor of small diameter microparticle production used in the present invention is from 0.01 to 1 part by weight, more preferably from 0.03 to 0.8 part by weight, still more preferably from 0.05 to 0.5 part by weight, with respect to the polymerizable monomer of 100 parts by weight.

With the use of the inhibitor of small diameter microparticle production having content in the above-specified range, the inhibitor can fully exhibit the effect of inhibiting the production of by-product small diameter microparticles.

When a content of the inhibitor of small diameter microparticle production used in the present invention is less than the above range, it is difficult to inhibit (or stop) the polymerization reaction of a polymerizable monomer dissolved (or present) in an aqueous dispersion medium (an aqueous phase), and the production of by-product small diameter microparticles may not be inhibited in polymerization. On the other hand, when a content of the inhibitor of small diameter microparticle production used in the present invention exceeds the above range, the polymerization reaction of the polymerizable monomer composition is inhibited and may remain in the toner.

In the present invention, an inhibitor of small diameter microparticle production having a structure represented by the following Formula 2, 3 or 4 may be preferably used since it is highly effective in inhibiting the production of by-product small diameter microparticles:

Formula 2:

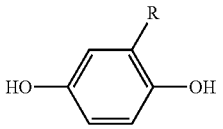

Formula 3:

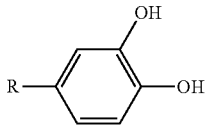

Formula 4:

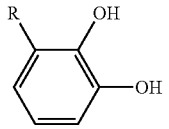

wherein, "R" denotes OX, $SO_3X$, $CO_2X$ or $CH{=}CHCO_2X$; and "X" denotes a hydrogen or a metal.

As the metal of the metal salt of the polyphenol compound represented by the Formula 2, 3 or 4 used in the present invention, there may be a monovalent metal such as lithium, sodium, potassium or the like; and a polyvalent metal such as magnesium, calcium, aluminum or the like. From the viewpoint of compatibility (solubility) of the metal salt of the polyphenol compound (an inhibitor of small diameter microparticle production) with the aqueous dispersion medium (the aqueous phase), the metal of the metal salt of the polyphenol compound may be preferably a monovalent metal.

As a specific example of the inhibitor of small diameter microparticle production represented by the Formula 2, 3 or 4 used in the present invention, in the Formula 2, there may be hydroxyhydroquinone, hydroquinone sulfonic acid, hydroquinone carboxylic acid, the metallic salt thereof or the like; in the formula 3, there may be caffeic acid, 3,4-dihydroxybenzoic acid, 3,4-dihydroxy benzene sulfonic acid, 1,2,4-trihydroxybenzene, the metallic salt thereof or the like; and in the formula 4, there may be pyrogallol, 2,3-dihydroxy benzoic acid, 2,3-dihydroxybenzene sulfonic acid, 2,3-dihydroxy cinnamic acid, the metallic salt thereof or the like.

From the viewpoint of maintaining the radical trapping ability, it is preferable that the inhibitor of small diameter microparticle production having the structure represented by the Formula 2, 3 or 4 is derived to a quinone derivative having the structure represented by the following Formula 5, 6 or 7 by oxidization. Moreover, the octanol/water partition coefficient logP thereof is preferably 0.6 or less, more preferably from −2.5 to 0.3.

Herein, the wording "by oxidization" means that hydrogen of the phenolic hydroxyl group is withdrawn from the inhibitor of small diameter microparticle production represented by the Formula 2, 3 or 4. When there is a range of calculated values for the octanol/water partition coefficient logP specified in the present invention, a center value thereof is referred to as the octanol/water partition coefficient logP.

Formula 5:

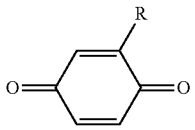

Formula 6:

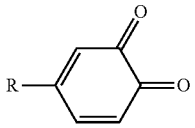

Formula 7:

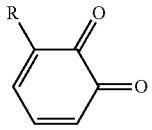

In the case of the quinone derivative represented by the Formula 5, 6 or 7 having the octanol/water partition coefficient logP in the above-specified range, compatibility (solubility) with the aqueous dispersion medium (the aqueous phase) becomes appropriate and the quinone derivative can be present in the aqueous dispersion medium (the aqueous phase) so that the quinone derivative can fully exhibit the effect of inhibiting the production of by-product small diameter microparticles in the aqueous dispersion medium.

Also, when the octanol/water partition coefficient logP exceeds the above-specified range, compatibility (solubility) of the quinone derivative with the aqueous dispersion medium (the aqueous phase) becomes inferior so that the quinone derivative may not fully exhibit the effect of inhibiting the production of by-product small diameter microparticles in the aqueous dispersion medium.

As long as the inhibitor of small diameter microparticle production used in the present invention can be in a state of being contained in the aqueous dispersion medium in the suspension process, the timing to add the inhibitor to the aqueous dispersion medium may not be particularly limited. It may be added in the aqueous dispersion medium at any stage of before or after the addition of the dispersion stabilizer or the polymerizable monomer composition. However, it is particularly preferable that the inhibitor is added to the aqueous dispersion medium after forming droplets of the polymerizable monomer composition and before starting the polymerization process, that is, to the aqueous dispersion medium being in a state of a suspension, since it is highly effective in inhibiting the production of by-product small diameter microparticles.

The polymerization initiator used in the present invention is preferably organic peroxide. As the organic peroxide, there may be a hydroperoxide compound, a dialkyl peroxide compound, a peroxyester compound, a diacyl peroxide compound, a peroxydicarbonate compound, a peroxyketal compound, a ketone peroxide compound or the like. Among them, the polymerization initiator used in the present invention is preferably the peroxyester compound represented by the following Formula 8:

Formula 8:

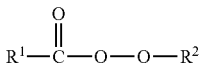

wherein, "$R_1$" and "$R_2$" are an alkyl group having a carbon number of 1 to 10.

"$R_1$" of the Formula 8 is preferably an alkyl group having a carbon number of 6 or less, more preferably an alkyl group having a carbon number of 5 or less. As a specific example of "$R_1$", there may be i-propyl, 1-methylpropyl, 1-ethylpropyl, 1-methylbutyl, 2-methylbutyl, 3-methylbutyl or the like. Among them, 1-methylpropyl or 1-ethylpropyl is particularly preferable.

"$R_2$" of the Formula 8 is preferably an alkyl group having a carbon number of 10 or less, more preferably an alkyl group having a carbon number 6 or less. As a specific example of "$R_2$", there may be t-butyl, t-hexyl, t-amyl or the like, and t-butyl is particularly preferable.

As a specific example of the peroxyester compound having the structure represented by the Formula 8, there may be t-butylperoxy-2-ethylbutanoate, t-butylperoxy-2-ethylhexanoate or the like. Among them, the t-butylperoxy-2-ethylbutanoate represented by the following Formula 9 is particularly preferable as the polymerization initiator used in the present invention from the viewpoint of capability of reducing residual amounts of a degradation product of the polymerization initiator and so on remained in the toner:

Formula 9:

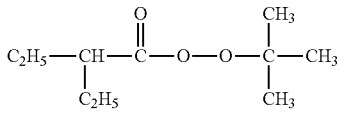

When using t-butylperoxy-2-ethylbutanoate represented by the Formula 9 together with hydroquinone, which is a conventionally known water-soluble polymerization inhibitor (or an inhibitor of small diameter microparticle production), the effect of inhibiting the production of by-product small diameter microparticles is weak. However, when using t-butylperoxy-2-ethylbutanoate represented by the Formula 9 together with the inhibitor of small diameter microparticle production specified in the present invention, the production of by-product small diameter microparticles is sufficiently inhibited, and residual amounts of an ether compound, which is a degradation product of the polymerization initiator, and so on remained in the toner can be reduced. The reason is presumed that the boiling point of the decomposition product of the polymerization initiator is reduced.

In the polymerization using the organic peroxide as the polymerization initiator, for example, when a peroxyester compound is used, once the peroxyester is pyrolyzed, it is decomposed to a corresponding alcohol radical and carboxylic radical. Thereafter, such radicals and an alkyl radical and the like produced by decarboxylation of the carboxylic radical are added to a monomer so as to progress the polymerization reaction. However, the radicals may produce by-product compounds such as various ether components or the like by recombination or drawing of hydrogen.

Since a toner with excellent printing durability can be obtained, an one-hour half-life temperature of the organic peroxide is preferably from 70° C. to 100° C., more preferably from 75° C. to 95° C.

The half-life temperature is an indicator showing easiness of occurrence of the cleavage of a polymerization initiator and a temperature at which the polymerization initiator is decomposed so as to be halved from the initial amount after a certain period of time when it is kept at a constant temperature. For example, the one-hour half-life temperature is a half-life temperature of which certain period of time is one hour.

In the present invention, a timing to add the polymerization initiator is not particularly limited. However, it is preferable to add the polymerization initiator to the aqueous dispersion medium being in a state of a suspension. It is particularly preferable to add the polymerization initiator in the aqueous dispersion medium after the inhibitor of small diameter microparticle production is added and before the polymerization process starts since it is highly effective in inhibiting the production of by-product small diameter microparticles.

An added amount of the polymerization initiator used in the present invention is preferably from 0.1 to 15 parts by weight, more preferably from 0.5 to 10 parts by weight, still more preferably from 2 to 5.5 parts by weight, with respect to the monovinyl monomer of 100 parts by weight.

In the present invention, in order to improve the control of a particle diameter and circularity of the colored resin particles, a dispersion stabilizer is contained in the aqueous dispersion medium for use. As the dispersion stabilizer, for example, there may be an inorganic compound which is soluble in acid or alkali but hardly soluble in water such as a metallic compound and so on including sulfate such as barium sulfate, calcium sulfate or the like; carbonate such as barium carbonate, calcium carbonate, magnesium carbonate or the like; phosphate such as calcium phosphate or the like; metallic oxide such as aluminum oxide, titanium oxide or the like; metallic hydroxide such as aluminum hydroxide, magnesium hydroxide, ferric hydroxide or the like; and so on. As the dispersion stabilizer, there may be also an organic polymer compound including a water-soluble polymer such as polyvinyl alcohol, methyl cellulose, gelatin or the like; an anionic surfactant; nonionic surfactant; an ampholytic surfactant; and so on.

Among the dispersion stabilizers, a colloid of the hardly water-soluble inorganic compound is preferably used. The colloid of the hardly water-soluble inorganic compound is obtained by mixing an aqueous solution of a polyvalent metal salt with an aqueous solution of a monovalent metal compound. Also, the colloid of the hardly water-soluble inorganic compound may be prepared by allowing an aqueous solution of the polyvalent metal salt or the monovalent metal compound to contact with a solid substance of the other.

As the polyvalent metal salt, there may be a halide salt with magnesium, aluminum, calcium, manganese, iron, nickel, copper, tin or the like; sulfate; nitrate; acetate; and so on. Among them, the salt of magnesium, aluminum or calcium is preferable. More specifically, as the salt of magnesium, there may be magnesium chloride, magnesium sulfate, magnesium nitrate, magnesium acetate, the hydrate thereof or the like. As the salt of aluminum, there may be aluminum chloride, aluminum sulfate, aluminum nitrate, aluminum acetate, the hydrate thereof or the like. As the salt of calcium, there may be calcium chloride, calcium sulfate, calcium nitrate, calcium acetate, the hydrate thereof or the like.

The polyvalent metal salts may be used alone or in combination of two or more kinds.

On the other hand, as the monovalent metal compound, there may be a salt or hydroxide of a monovalent metal with a negative ion selected from a phosphate ion, a hydrogen phosphate ion, a carbonate ion and a hydroxide ion.

As the monovalent metal of the monovalent metal compound, at least one kind of monovalent metal selected from a group consisting of lithium, sodium and potassium is preferable. As the monovalent metal, more specifically, there may be hydroxide such as lithium hydroxide, sodium hydroxide, potassium hydroxide or the like; phosphate such as lithium phosphate, sodium phosphate, potassium phosphate or the like; carbonate such as lithium carbonate, sodium carbonate, potassium carbonate or the like and so on. Among them, hydroxide is preferable.

The monovalent metal compounds may be used alone or in combination of two or more kinds.

The dispersion stabilizers may be used alone or in combination of two or more kinds. An added amount of the dispersion stabilizer is preferably from 0.1 to 20 parts by weight, more preferably from 0.2 to 10 parts by weight, with respect to polymerizable monomer of 100 parts by weight.

Also, with respect to the aqueous dispersion medium of 100 parts by weight, an added amount of the dispersion stabilizer is preferably from 0.1 to 10 parts by weight, more preferably from 0.2 to 5 parts by weight.

In the present invention, when using the hardly water-soluble inorganic compound as a dispersion stabilizer, pH of the aqueous dispersion medium is preferably from 8 to 11, more preferably from 8.5 to 10.5. If pH of the aqueous dispersion medium used in the present invention is less than the above range, dispersion stability decreases so that the circle degree of colored resin particles to be obtained may decrease or the particle diameter distribution may enlarge. On the other hand, if pH exceeds the above range, removal of the dispersion stabilizer may be difficult.

pH of the aqueous dispersion medium is measured by means of a pH meter at a temperature of 25° C. or less. As the pH meter, for example, D-14 (product name; manufactured by HORIBA, Ltd.) may be used.

(2) Polymerization Process

A temperature of the desired suspension (the aqueous dispersion medium containing droplets of the polymerizable monomer composition) obtained in "(1) Suspension process of obtaining a suspension (droplets forming process)" is raised to polymerize in the presence of the inhibitor of small diameter microparticle production and the polymerization initiator.

In the present invention, polymerization temperature is preferably 50° C. or more, more preferably from 60 to 95° C. Polymerization reaction time is preferably from 1 to 20 hours, more preferably from 2 to 15 hours.

In order to polymerize droplets of the polymerizable monomer composition in a state of being stably dispersed, the polymerization reaction may proceed while agitating the droplets for dispersion treatment in the polymerization process continuously following the suspension process (droplets forming process).

By selecting an inhibitor of small diameter microparticle production having the above-specified parameters and allowing the same of a specific amount to be contained in the aqueous dispersion medium (the aqueous phase) in "(1-2) Suspension process of obtaining suspension", the polymerization reaction proceeding in this process of the polymerizable monomer dissolved (or present) in the aqueous dispersion medium (the aqueous phase), for example, a radical monomer, can be inhibited (or stopped). Thus, production of by-product small diameter microparticles in polymerization can be efficiently inhibited. For this reason, an average number of small diameter microparticles per colored resin particle obtained in the polymerization process can be controlled to preferably 200 or less, more preferably 100 or less, still more preferably 50 or less.

The average number of small diameter microparticles per colored resin particle is a value calculated in such a manner that aqueous dispersion containing colored resin particles after polymerization process is collected and prepared to be a sample for measurement with a scanning electron microscopy (SEM); the prepared sample is photographed at 5,000 magnification in five fields of view by means of the scanning electron microscopy; five colored resin particles are randomly selected in each image; the number of small diameter microparticles observed on the surface of 25 colored resin particles in total is counted; and the average number of small microparticles per colored resin is calculated therefrom.

The number of small diameter microparticles per colored resin particle can be measured by means of a commercially available scanning electron microscopy. For example, it can be measured by means of a field emission scanning electron microscopy (product name: S-4700; manufactured by: Hitachi, Ltd.).

The colored resin particles obtained by polymerization of the polymerizable monomer composition may be used as a polymerized toner or as a polymerized toner by adding an external additive. Also, it is preferable to form so-called core-shell type (or "capsule type") colored resin particles, which can be obtained by using the colored resin particles as a core layer and forming a shell layer, a material of which is different from that of the core layer, around the core layer.

The core-shell type colored resin particles can take a balance of lowering of fixing temperature and prevention of blocking at storage of a polymerized toner by covering the core layer comprising a substance having a low-softening point with a substance having a high softening point.

A method for producing the core-shell type colored resin particles mentioned above may not be particularly limited, and may be produced by a conventional method. An in situ polymerization method or a phase separation method is preferable from the viewpoint of production efficiency.

The method of producing the core-shell type colored resin particles according to the in situ polymerization method will be hereinafter described.

A polymerizable monomer (a polymerizable monomer for shell) for forming a shell layer and a polymerization initiator are added to an aqueous dispersion medium to which colored resin particles are dispersed followed by polymerization, thus the core-shell type colored resin particles can be obtained.

As a polymerizable monomer for shell, the above-mentioned polymerizable monomer or the like can be similarly used. Among them, a monomer which provides a polymer having "Tg" of more than 80° C. such as styrene, methyl methacrylate or the like may be preferably used alone or in combination of two or more kinds.

As a polymerization initiator used for polymerization of the polymerizable monomer for shell, there may be polymerization initiators such as a metal persulfate including potassium persulfate, ammonium persulfate or the like; a water-soluble azo compound such as 2,2'-azobis-([2-methyl-N-(2-hydroxyethyl) propionamide], 2,2'-azobis-[2-methyl-N-(1,1-bis (hydroxymethyl)-2-hydroxyethyl)propionamide] or the like; and so on.

In the present invention, an amount of the polymerization initiator is preferably from 0.1 to 30 parts by weight, more preferably from 1 to 20 parts by weight with respect to the polymerizable monomer for shell of 100 parts by weight.

(3) Stripping Process

In order to prevent an unreacted polymerizable monomer (a remaining monomer, mainly styrene) and a decomposition product of the polymerization initiator (mainly an ether component) from remaining in the toner, it is preferable that an aqueous dispersion of the colored resin particles obtained is subject to a stripping treatment. The stripping treatment is a treatment to remove remaining volatiles from the colored resin particles in a state that the colored resin particles are dispersed in the aqueous dispersion medium, that is, in the a state of an aqueous dispersion of the colored resin particle.

A stripping treatment system used in the present invention will be explained hereinafter. As shown in FIG. 1, the system facilitates gas circulation lines (7, 10, 12 and 13) outside, and each gas circulation line comprises a blower 6, a removal device for volatiles 11, a condenser 8 and a condensation tank 9. An evaporator 1 may be the same as the container (reactor) used in the polymerization process or may be different. The evaporator 1 comprises an agitator 3 with stirring vane to agitate an aqueous dispersion 4 of colored resin particles inside of the evaporator 1. On the outside of the evaporator 1, a jacket 2 for heating or cooling in the stage of polymerization and heating in the stripping treatment may be disposed.

As the stripping treatment, there may be a method of blowing saturated vapor to the aqueous dispersion 4 of colored resin particles; a method of depressurizing the aqueous dispersion 4 of colored resin particles; and a method of blowing gas to the aqueous dispersion 4 of colored resin particles. Among them, the method of blowing gas to the aqueous dispersion 4 of colored resin particles is preferable. When employing the method of blowing gas, the gas includes nitrogen, an inert gas of carbon dioxide or the like, air and so on. Among them, nitrogen is preferable. The gas may be blown to a gas phase part of the evaporator (onto the surface of the aqueous dispersion 4 of colored resin particles). However, it is preferable to blow the gas into the aqueous dispersion 4 of colored resin particles.

After completing the stripping treatment, foam formation is likely to occur on the surface of the aqueous dispersion 4 of colored resin particles. If forms are overproduced and the aqueous dispersion 4 of colored resin particles spills from the evaporator 1, it flows into the gas circulation line 7 so as to contaminate. For this reason, it is preferable to use a defoaming agent with an effect of inhibiting foam formation. As the defoaming agent, there may be a fatty oil-based defoaming agent, a mineral oil-based defoaming agent, a polyether defoaming agent, a polyalkylene glycol-contained nonionic surfactant or the like. It is preferable to add the defoaming agent to the aqueous dispersion 4 of colored resin particles. An amount of the defoaming agent to be added is preferably from 0.01 to 1 part by weight, more preferably from 0.05 to 0.5 part by weight with respect to the polymerizable monomer composition of 100 parts by weight.

In order to efficiently remove remaining volatiles by using the stripping treatment system, a temperature of the stripping treatment is preferably a glass transition temperature (Tg) of a binder resin comprising the colored resin particles or more and less than (Tg+75)° C., more preferably (Tg+10)° C. or more and less than (Tg+65)° C. Time required for the stripping treatment may be appropriately determined depending on the scale of a treatment device and amounts of volatiles such as styrene, the ether component and so on remained in the colored resin particles just after polymerization. However, it is preferably from 0.5 to 40 hours, more preferably from 1 to 20 hours.

(4) Processes of Washing, Filtering, Dehydrating and Drying

It is preferable that after completion of polymerization, the aqueous dispersion of colored resin particles obtained in the process (2) or (3) is subject to a series of operations including filtering, washing to remove the dispersion stabilizer, filtering, dehydrating, and drying several times as needed according to a conventional method.

Firstly, in order to remove the dispersion stabilizer remained in the aqueous dispersion of colored resin particles, acid or alkali is added to the aqueous dispersion to wash.

If the dispersion stabilizer is an acid-soluble inorganic compound, acid is added to the aqueous dispersion of colored resin particles. On the other hand, if the dispersion stabilizer is an alkali-soluble inorganic compound, alkali is added to the aqueous dispersion of colored resin particles.

When using an acid-soluble inorganic compound as the dispersion stabilizer, it is preferable to control pH of the aqueous dispersion of colored resin particles to 6.5 or less by adding acid. It is more preferable to control pH to 6 or less. As the acid to be added, an inorganic acid such as a sulfuric acid, a hydrochloric acid, a nitric acid or the like, or an organic acid such as a formic acid, acetic acid or the like may be used. Among them, the nitric acid is particularly preferable for high removal efficiency and small impact on production facilities.

As methods of dewatering and filtering, various known methods or the like can be used and may not be particularly limited. For example, there may be a centrifugal filtration, a pressure filtration, a vacuum filtration or the like. As a washing device, there may be a peeler centrifuge, a siphon peeler centrifuge or the like. A method of drying may not be particularly limited also, and various known methods can be used. For example, various methods such as vacuum drying, flash drying, a spray dryer and so on may be used.

(5) Colored Resin Particles

The colored resin particles obtained through "(4) Processes of washing, filtering, dehydrating and drying" will be hereinafter described. Hereinafter, the colored resin particles include both core-shell type colored resin particles and colored resin particles which are not core-shell type.

A volume average particle diameter "Dv" of the colored resin particles comprising the toner for developing an electrostatic image of the present invention may be preferably from 3 to 15 μm, more preferably from 4 to 12 μm. If "Dv" is less than the above range, flowability of the toner lowers, transferability of the toner may deteriorate, blur may generate, or printing density may lower. If "Dv" exceeds the above range, resolution of an image to be obtained may decline.

A number-based percentage of colored resin particles with a particle diameter of 5 μm or less is preferably 25% or less, more preferably 18% or less. If the number-based percentage of the colored resin particles with a particle diameter of 5 μm or less exceeds the above range, flowability of the toner to be obtained lowers and transferability deteriorates. As a result, blur or decrease in printing density is likely to occur.

As for the colored resin particles comprising the toner for developing an electrostatic image of the present invention, a ratio "Dv/Dp" of a volume average particle diameter "Dv" and a number average particle size "Dp" may be preferably from 1.0 to 1.3, more preferably from 1.0 to 1.2. If "Dv/Dp" exceeds the above range, blur may generate, and transferability, printing density and resolution may decline. The volume average particle diameter "Dv" and the number average particle size "Dp" of the colored resin particles may be measured, for example, by means of a particle diameter measuring device (product name: MULTISIZER; manufactured by Beckman Coulter, Inc.) or the like.

An average circularity of the colored resin particles comprising the toner for developing an electrostatic image is preferably from 0.970 to 0.995, more preferably from 0.975 to 0.990.

In the present invention, circularity is a value obtained by dividing a perimeter of a circle having an area same as a projected image of a particle by a perimeter of a particle image. Also, in the present invention, an average circularity is used as a simple method of presenting a shape of a particle quantitatively and is an indicator showing the level of convexo-concave shapes of the colored resin particle. The average circularity is "1" when the colored resin particles is an absolute sphere, and becomes smaller as the shape of the surface of the colored resin particles becomes more complex. In order to obtain the average circularity (Ca), firstly, circularity (Ci) of each of measured "n" particles of 0.6 μm or more by a diameter of the equivalent circle is calculated by the following Calculation formula 2. Next, the average circularity (Ca) is obtained by the following Calculation formula 3.

Calculation Formula 2:

circularity ($Ci$)=a perimeter of a circle having an area same as a projected area of a particle image/a perimeter of a particle image Calculation Formula 3:

$$Ca = \frac{\sum_{i=1}^{n} (Ci \times fi)}{\sum_{i=1}^{n} (fi)}$$

In the Calculation formula 3, "fi" is a frequency of a particle of circularity (Ci).

The above-mentioned circularity and average circularity may be measured by means of a flow particle image analyzer FPIA-2000, FPIA-2100 or FPIA-3000 (product name; manufactured by Sysmex Co.) or the like.

If the average circularity of the colored resin particles exceeds the above range, the colored resin particles can easily pass through between a cleaning blade and a photosensitive member so that cleaning problems such as filming on the photosensitive member or fog of printed image is likely to occur. If the average circularity of the colored resin particles is less than the above range, reproductivity of thin lines may decrease.

(6) Toner for Developing Electrostatic Image

The colored resin particles obtained in the present invention may be a toner for developing an electrostatic image as it is or a toner for developing an electrostatic image by adding carrier particles (ferrite, iron powder or the like). Also, the colored resin particles and an external additive may be mixed by means of a high-speed agitator such as HENSCHEL MIXER (product name; manufactured by: Mitsui Mining Co., Ltd.) or the like to form a one-component toner in order to control charge property, flowability, shelf stability or the like of a toner. Further, in addition to the colored resin particles and the external additive, carrier particles may be mixed to form a two-component developer.

As the external additive, there may be inorganic microparticles such as silica, titanium oxide, aluminum oxide, zinc oxide, tin oxide, calcium carbonate, calcium phosphate, cerium oxide or the like; and organic microparticles comprising a polymethyl methacrylate resin, silicone resin, melamine resin or the like. Among them, the inorganic microparticles are preferable. Silica and titanium oxide are more preferable, and silica is still more preferable. Further, as the external additive, two or more kinds of microparticles may be preferably used in combination.

In the present invention, an amount of the external additive desired to be used is generally in the range from 0.1 to 6 parts by weight, preferably from 0.2 to 5 parts, by weight, with respect to the colored resin particles of 100 parts by weight.

From the viewpoint of inhibiting generation of ozone and obtaining excellent charging property, the toner for developing an electrostatic image of the present invention may preferably be a toner having positively charging ability which is used in a positively charging method.

(7) Residual Amounts of Unreacted Polymerizable Monomer and Decomposition Product of Polymerization Initiator Among the polymerizable monomers contained in the polymerizable monomer composition, if there is a monomer of which ratio to be used accounts for 70% or more, a residual amount of a monovinyl monomer with the highest ratio of use (for example, styrene) may be used as an indicator of an unreacted polymerizable monomer (a remaining monomer).

In the present invention, the residual amount of styrene remained in the toner is preferably 200 ppm or less, more preferably 100 ppm or less, further preferably 50 ppm or less.

In the present invention, by controlling the residual amount of styrene remained in the toner to be in the above-mentioned extremely small range, a toner which produces less odor in printing and is excellent in shelf stability at high temperature can be obtained.

Among the decomposition products remained in the toner, if an ether component derived from organic peroxide accounts for most of the decomposition products, the residual amount of the ether component may be used as an indicator of the decomposition products of the polymerization initiator.

In the present invention, the ether component means a monoether component in which only one ether bond is present in one molecule exhibiting volatilization property upon fixing of the toner. A polyether having plurality of ether bonds in one molecule is not included therein.

In the present invention, the residual amount of the ether component remained in the toner is preferably 1,000 ppm or less, more preferably 500 ppm or less, still more preferably 100 ppm or less.

In the present invention, by controlling the residual amount of the ether component remained in the toner to be in the above-mentioned extremely small range, a toner which produces less odor in printing and is excellent in shelf stability at high temperature can be obtained.

Quantitative measurement on the residual amounts of styrene and the ether component remained in the toner of the present invention may be conducted by gas chromatography.

According to the production method of the toner for developing an electrostatic image of the present invention including the above-mentioned processes, by using a specific amount of the inhibitor of small diameter microparticle production having the parameter specified in the present invention, small diameter microparticles produced as a by-product when a suspension polymerization method is conducted can be sufficiently inhibited, thus, the toner of the present invention is easy to wash and excellent in productivity. Also, since residual amounts of decomposition products of the unreacted polymerizable monomer (remaining monomer) and the polymerization initiator remained in the toner can be reduced, the toner of the present invention is excellent in shelf stability at high temperature (preventing aggregation of the toner during storage). Further, the toner of the present invention is an environment-friendly toner not deteriorating the environment, which produces less odor derived from the unreacted polymerizable monomer (remaining monomer) and decomposition products of a polymerization initiator in printing.

EXAMPLES

Hereinafter, the present invention will be explained further in detail with reference to examples and comparative examples. However, the scope of the present invention may not be limited to the following examples. Herein, "part(s)" and "%" are based on weight if not particularly mentioned.

Testing methods employed in the examples and the comparative examples of the present invention are as follows.

(1) Minimum Reaction Activation Energy $E_{min}$

A reaction activation energy "E" was obtained by a computational chemistry approach on 11 kinds of chemical substances "A" to "K" shown in Table 2.

As the computational chemistry approach, calculation was conducted by an ab initio molecular orbital method based on Density Functional Theory (DFT) for evaluation. In the molecular orbital calculation, Blyp was used for a functional and DND was used for a basis function. As a molecular orbital calculation software, Dmo13 (product name; manufactured by: Accelrys Software Inc.) was used for calculation.

Among reaction activation energies obtained based on the number of phenolic hydroxyl groups of each target chemical substance, a reaction activation energy "E" with the minimum value is a minimum reaction activation energy $E_{min}$.

Figure 2:
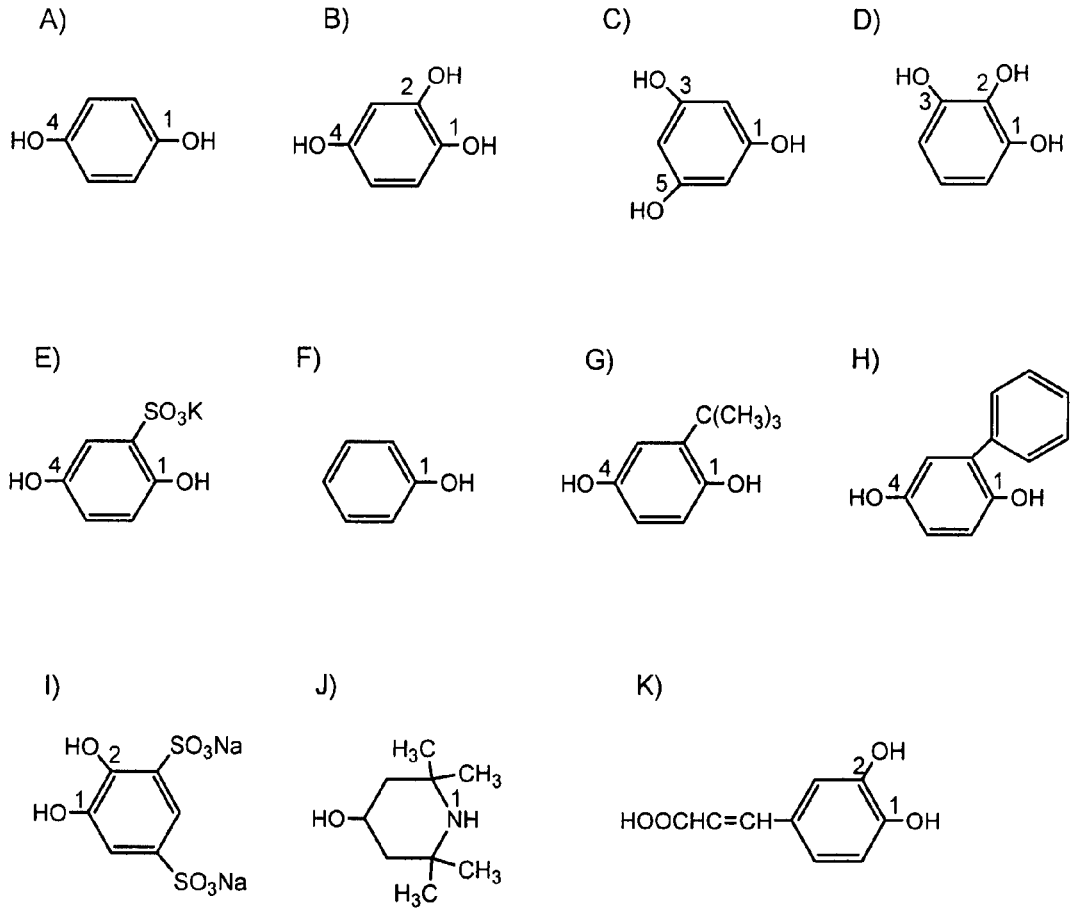
FIG. 2 shows structures of chemical substances subject to consideration for the reaction activation energy and the octanol/water partition coefficient.
Figure 3:
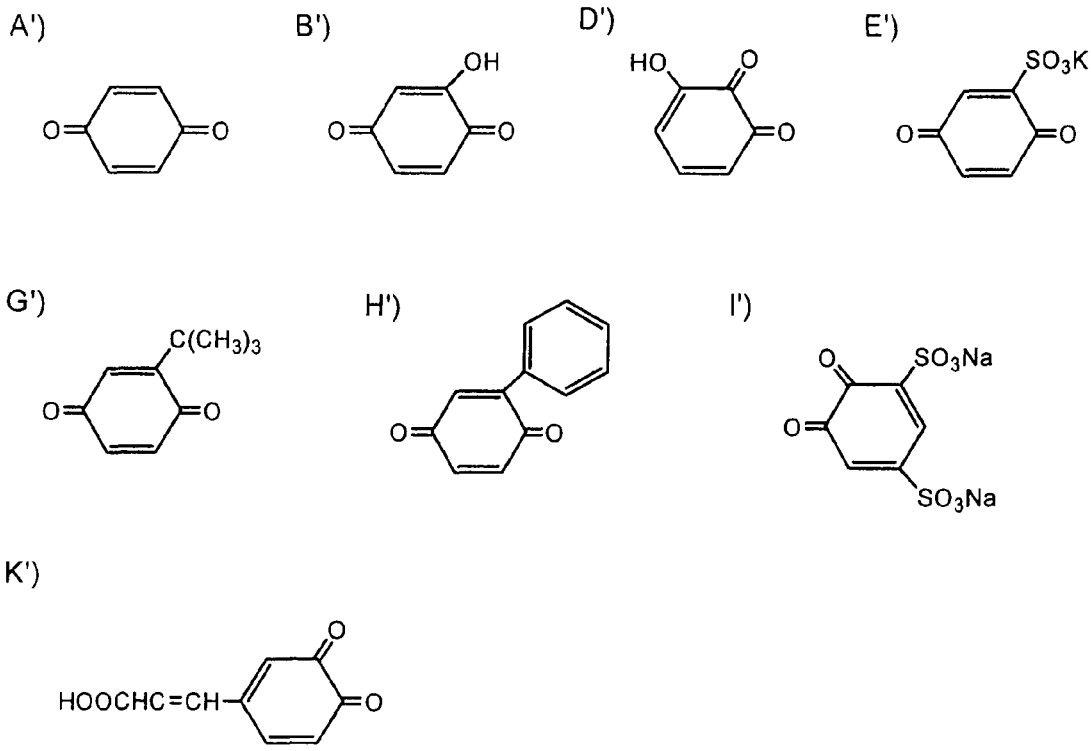
FIG. 3 shows structures of chemical substances subject to consideration for the octanol/water partition coefficient.

In FIG. 2, the sign in each structure is a sign to specify phenolic hydroxyl group. However, "J" is a sign to specify a NH group since FIG. 2 shows a model of a hydrogen radical abstraction reaction from the NH group.

(2) Octanol-Water Partition Coefficient LogP

An octanol/water partition coefficient logP was obtained by a computational chemistry approach on 11 kinds of chemical substances "A" to "K" shown in Table 2 and 8 kinds of chemical substances (quinone derivatives) "A'", "B'", "D'", "E'", "G'", "H'", "I'", and "K'" shown in Table 3.

As the computational chemistry approach, calculation was conducted with the use of ACD/LogP DB of Advanced Chemistry Development Inc.

Since "E" and "I" in FIG. 2 have no parameter of potassium and sodium, hydrogen was used as a replacement element thereof.

(3) Average Number of Small Diameter Microparticles

In 3 ml of an aqueous dispersion containing colored resin particles after polymerization process, 4 ml of 10% $H_2SO$ was added to completely dissolve the dispersion stabilizer. 2 ml of the mixture was dropped on a filter paper (product name: No. 2; manufactured by: Advantec Toyo Kaisha, Ltd.) for filtration and dried in air to prepare a sample for a scanning electron microscopy (SEM).

The air-dried colored resin particles were subject to platinum deposition and scanning electron microscope (SEM) observation by means of a field emission scanning electron microscopy (product name: S-4700; manufactured by: Hitachi, Ltd.) with an accelerating voltage of 5 kV at 5,000 magnification.

The sample was randomly photographed in five fields of view, and five colored resin particles were randomly selected in each image to count the number of small diameter microparticles observed on the surface of 25 colored resin particles in total. The average number of small diameter microparticles per colored resin particle was calculated therefrom.

(4) Residual Amounts of Styrene and Ether Component

The toner was precisely weighed to be 3 g up to the unit of 1 mg. 27 g of ethyl acetate was added to the weighed toner of 3.0 g and agitated for 15 minutes. Then, 13 g of methanol was added there to and agitated for another 10 minutes. A solution thus obtained was left to precipitate insoluble contents. A supernatant liquid of the solution was taken as a measurement sample and 2 μl thereof was charged into a gaschromatograph to quantitate styrene and an ether component.

Measurement conditions of the gaschromatograph are as follows. A column (product name: DB-5; manufactured by: Agilent Technologies) with an inside diameter of 0.25 mm and a length of 30 m was used. The column was kept at 40° C. for three minutes. Then, the temperature was increased to 130° C. at a pace of 10° C. per minute and further increased to 230° C. at a pace of 20° C. per minute so that an injection temperature was 200° C. and a FID detection temperature was 250° C. As a standard sample for quantitative determination, an ethyl acetate/methanol solution of each component was used.

(5) Evaluation of Shelf Stability at High Temperature

A container charged with a toner of 20 g was hermetically closed and sunk in a constant temperature water bath kept at 60° C. The container was removed therefrom after five hours. The toner was transferred from the container onto a 42 mesh screen while being kept from vibration and set on a powder characteristics measuring device (product name: POWDER CHARACTERISTICS TESTER PT-R; manufactured by: Hosokawa Micron Corporation). The screen was vibrated at an amplitude of 1.0 mm for 30 seconds. A weight of the toner remained on the screen was measured and referred to as a weight of the aggregated toner. Shelf stability rate (%) of the toner at high temperature was calculated from the ratio (% by weight) of the weight of the toner remained on the screen (corresponding to the weight of the aggregated toner) with respect to the weight of the toner measured (20 g).

As the value of the shelf stability rate (%) of the toner at high temperature becomes smaller, the toner is less aggregated and more excellent in shelf stability at high temperature.

Example 1

75 parts of styrene and 25 parts of n-butyl acrylate as monovinyl monomers, 7 parts of carbon black (product name: #25BS; manufactured by: Mitsubishi Chemical Corporation) as a black colorant, 1 part of a charge control resin (a styrene/acrylic resin; product name: FCA-207P; manufactured by: Fujikura Kasei Co., Ltd.) and 5 parts of dipentaerythritol hexamyristate as a release agent were agitated, mixed together and uniformly dispersed to prepare a polymerizable monomer composition.

Separately, an aqueous solution of 4.8 parts of sodium hydroxide dissolved in 50 parts of ion-exchanged water was gradually added to an aqueous solution of 8.5 parts of magnesium chloride dissolved in 170 parts of ion-exchanged water while agitating to prepare a magnesium hydroxide colloid (hardly water-soluble metal hydroxide colloid) dispersion liquid.

The polymerizable monomer composition was charged into the magnesium hydroxide colloid dispersion liquid thus obtained and agitated at room temperature. Then, 5 parts of t-butylperoxy-2-ethylbutanoate represented by the following Formula 9 (product name: TRIGONOX 27; manufactured by: Akzo Nobel N.V.; purity: 98%; molecular weight: 188; one-hour half-life temperature: 94° C.; and ten-hour half-life temperature: 75° C.) as a polymerization initiator, 1 part of tetraethyl thiuram disulfide as a molecular weight modifier and 0.7 part of divinyl benzene as a cross-linking agent were added therein. The mixture was subject to a high shear agitation at 15,000 rpm for 10 minutes by means of an in-line type emulsifying and dispersing machine (product name: MILDER; manufactured by Pacific Machinery & Engineering Co., Ltd) to form droplets of the polymerizable monomer composition.

After forming droplets of the polymerizable monomer composition, as an inhibitor of small diameter microparticle production, 0.1 part of potassium hydroquinone sulfonate represented by the following Formula 10 was added thereto and further agitated.

Formula 9:

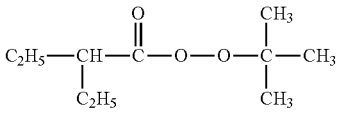

Formula 10:

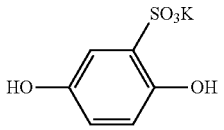

A thus obtained suspension having droplets of the polymerization monomer composition dispersed (a polymerizable monomer composition dispersion liquid) was charged into a reactor furnished with a stirring vane and a temperature thereof was raised to 90° C. to start a polymerization reaction. When a polymerization conversion rate reached 95%, 1 part of methyl methacrylate as a polymerizable monomer for shell and 0.1 part of 2,2'-azobis-[2-methyl-N-(1,1-bis(hydroxymethyl)-2-hydroxyethyl)propionamide] (product name: VA-086; manufactured by: Wako Pure Chemical Industries, Ltd.) dissolved in 10 parts of ion-exchanged water were added to the suspension. After continuing the reaction for three hours at 90° C., the reaction was stopped to obtain an aqueous dispersion of colored resin particles having a core-shell structure.

A part of the aqueous dispersion thus obtained was used for measurement of the number of small diameter microparticles.

The aqueous dispersion of colored resin particles thus obtained was subject to the following stripping treatment by means of a system shown in FIG. 2 and by a method of blowing gas as a stripping process.

Firstly, the aqueous dispersion of colored resin particles was diluted with ion-exchanged water to have a solid density of 20% and supplied to an evaporator 1. Next, 0.1 part of a defoaming agent (product name: SN DEFOAMER 180; manufactured by: San Nopco Limited) was added to the evaporator 1. A nitrogen gas was run into the evaporator 1, and a gas phase part in the evaporator was substituted with the nitrogen gas. After the aqueous dispersion of colored resin particles was heated to 80° C. while agitating with the stirring vane 3, a blower 6 was activated to control a flow rate of the nitrogen gas to 0.6 $m^3$/(hr·kg). The nitrogen gas was blown in the aqueous dispersion of colored resin particles through a gas blowing tube 5, a gas outlet of which has a straight tube shape, to remove volatiles from the colored resin particle.

The nitrogen gas after stripping was directed to a condenser 8 and a condensation tank 9 in this order through a gas circulation line 7. The nitrogen gas after condensation was directed to a removal device for volatiles 11 (an absorption tower filled with activated carbon) through a gas circulation line 10 to remove volatiles contained in the nitrogen gas. The nitrogen gas, which no longer contains volatiles, was blown to the evaporator 1 again through a gas circulation line 12, the blower 6 and then a gas circulation line 13.

In the stripping process, the treatment was performed for six hours at a temperature of the aqueous dispersion of colored resin particles of 80° C., a pressure in the evaporator 1 of 101 kPa and a flow rate of the nitrogen gas of 0.6 $m^3$/(hr·kg). After the treatment for six hours, the aqueous dispersion of colored resin particles was cooled down to room temperature.

Thereafter, the aqueous dispersion of colored resin particles was subject to acid washing in which sulfuric acid was added to be pH of 6.5 or less while agitating at room temperature. After separating water by filtration, the aqueous dispersion of colored resin particles was subject to water washing in which another 500 parts of ion-exchanged water was added to make a slurry again. After repeating a series of dewatering and water washing several times, the colored resin particles were separated by filtration and charged into a container of a vacuum dryer for vacuum drying at 30 torr pressure and 50° C. for one day.

The volume average particle diameter "Dv" of the colored resin particles obtained by drying was 9.5 μm, and "Dv/Dp" (volume average particle diameter/number average particle size) was 1.16.

To the colored resin particles thus obtained of 100 parts, silica particles subjected to a hydrophobicity-imparting treatment (product name: TG820F; manufactured by: Cabot Corporation) of 0.8 part and silica particles subjected to a hydrophobicity-imparting treatment (product name: NA50Y; manufactured by: Nippon Aerosil Co., Ltd.) of 1.0 part were added and mixed by means of HENSCHEL MIXER (product name) to produce a non-magnetic one-component toner of Example 1 for testing.

Example 2

A toner of Example 2 was produced in the same condition as in Example 1 except that the added amount of the potassium hydroquinone sulfonate represented by the Formula 10, which is an inhibitor of small diameter microparticle production, was changed to 0.3 part.

Example 3

A toner of Example 3 was produced in the same condition as in Example 1 except that the inhibitor of small diameter microparticle production was altered to hydroxyhydroquinone represented by the following Formula 11:

Formula 11:

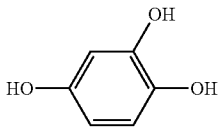

Example 4

A toner of Example 4 was produced in the same condition as in Example 1 except that the inhibitor of small diameter microparticle production was altered to caffeic acid represented by the following Formula 12:

Formual 12:

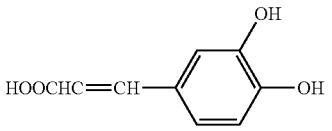

Example 5

A toner of Example 5 was produced in the same condition as in Example 1 except that the inhibitor of small diameter microparticle production was altered to pyrogallol represented by the following Formula 13:

Formula 13:

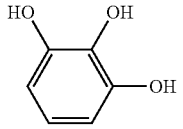

Comparative Example 1

A toner of Comparative example 1 was produced in the same condition as in Example 1 except that the inhibitor of small diameter microparticle production was altered to hydroquinone represented by the following Formula 14:

Formula 14:

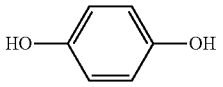

Comparative Example 2

A toner of Comparative example 2 was produced in the same condition as in Comparative example 1 except that the polymerization initiator was altered to t-butylperoxy-2-ethyl hexanoate (product name: PERBUTYL O; manufactured by: NOF Corporation) represented by the following Formula 15:

Formula 15:

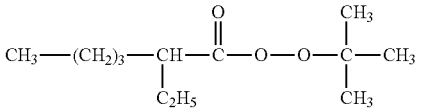

Comparative Example 3

A toner of Comparative example 3 was produced in the same condition as in Example 1 except that the inhibitor of small diameter microparticle production was altered to t-butylhydroquinone represented by the following Formula 16:

Formula 16:

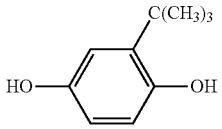

Comparative Example 4

A toner of Comparative example 4 was produced in the same condition as in Example 1 except that the inhibitor of small diameter microparticle production was altered to phloroglucinol represented by the following Formula 17:

Formula 17:

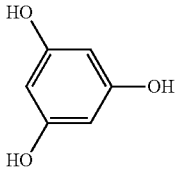

Comparative Example 5

A toner of Comparative example 5 was produced in the same condition as in Example 1 except that the inhibitor of small diameter microparticle production was altered to phenylhydroquinone represented by the following Formula 18:

Formula 18:

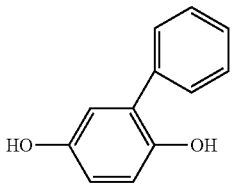

<Results>

Calculation results for the reaction activation energy "E" of the structures are shown in Table 1. Calculation results for the octanol/water partition coefficient logP are shown in Table 2. Also, test results of the toners produced in Examples and Comparative examples are shown in Table 3.

TABLE 1

| | | Reaction activation energy "E" (kcal/mol) | | | | |
|---|---|---|---|---|---|---|
| Structure | Chemical | 1-position | 2-position | 3-position | 4-position | 5-position |
| A | Hydroquinone | 8.9 | — | — | 8.9 | — |
| B | Hydroxyhydroquinone | 4.9 | 14.7 | — | 8.4 | — |
| C | Phloroglucinol | 10.1 | — | 10.1 | — | 10.1 |
| D | Pyrogallol | 7.1 | 2.2 | 7.1 | — | — |
| E | Potassium hydroquinone sulfonate | 14.3 | — | — | 0 | — |

TABLE 1-continued

| Structure | Chemical | Reaction activation energy "E" (kcal/mol) 1-position | 2-position | 3-position | 4-position | 5-position |
|---|---|---|---|---|---|---|
| F | Phenol | 11.8 | — | — | — | — |
| G | t-butylhydroquinone | 6.9 | — | — | 7.5 | — |
| H | Phenylhydroquinone | 9.6 | — | — | 7.4 | — |
| I | 1,2-dihydroxy-3,5-benzenesulfonic acid disodium salt | 9.3 | 13.3 | — | — | — |
| J | POLYSTOP | 24.5 | — | — | — | — |
| K | Caffeic acid | 1.4 | 7.7 | — | — | — |

TABLE 2

| Octanol/water partition coefficient logP (center value) | | | |
|---|---|---|---|
| A | 0.64 | A' | 0.27 |
| B | 0.06 | B' | 0.03 |
| C | 0.06 | — | — |
| D | 0.29 | D' | −0.83 |
| E | −1.35 | E' | −0.54 |
| F | 1.48 | — | — |
| G | 2.33 | G' | 2.08 |
| H | 2.09 | H' | 2.47 |
| I | −4.39 | I' | −2.20 |
| J | 1.55 | — | — |
| K | 1.42 | K' | −1.02 |

TABLE 3

| | Inhibitor of small diameter microparticle production | | | | | Polymerization initiator | |
|---|---|---|---|---|---|---|---|
| | Chemical name | Structure | Minimum reaction activation energy E min (kcal/mol) | Octanol/water partition coefficient LogP (center value) | Added amount (Part) | Chemical name | Product name |
| Example 1 | Potassium hydroquinone sulfonate | E | 0 | −1.35 | 0.1 | t-butylperoxy-2-ethylbutanoate | TRIGO-NOX 27 |
| Example 2 | Potassium hydroquinone sulfonate | E | 0 | −1.35 | 0.3 | t-butylperoxy-2-ethylbutanoate | TRIGO-NOX 27 |
| Example 3 | Hydroxyhydro-quinone | B | 4.9 | 0.06 | 0.1 | t-butylperoxy-2-ethylbutanoate | TRIGO-NOX 27 |
| Example 4 | Caffeic acid | K | 1.4 | 1.42 | 0.1 | t-butylperoxy-2-ethylbutanoate | TRIGO-NOX 27 |
| Example 5 | Pyrogallol | D | 2.2 | 0.29 | 0.1 | t-butylperoxy-2-ethylbutanoate | TRIGO-NOX 27 |
| Comparative Example 1 | Hydroquinone | A | 8.9 | 0.64 | 0.1 | t-butylperoxy-2-ethylbutanoate | TRIGO-NOX 27 |
| Comparative Example 2 | Hydroquinone | A | 8.9 | 0.64 | 0.1 | t-butylperoxy-2-ethylhexanoate | PER-BUTYL O |
| Comparative Example 3 | t-Butylhydro-quinone | G | 6.9 | 2.33 | 0.1 | t-butylperoxy-2-ethylbutanoate | TRIGO-NOX 27 |
| Comparative Example 4 | Phloroglucinol | C | 10.1 | 0.06 | 0.1 | t-butylperoxy-2-ethylbutanoate | TRIGO-NOX 27 |
| Comparative Example 5 | Phenylhydro-quinone | H | 7.4 | 2.09 | 0.1 | t-butylperoxy-2-ethylbutanoate | TRIGO-NOX 27 |

| | Average number of small diameter microparticles per colored resin particle | Toner: Residual amount of ether component (ppm) | Toner: Residual amount of styrene (ppm) | Toner: Shelf stability at high temperature (%) |
|---|---|---|---|---|
| Example 1 | 5.6 | 25 | 15 | 1.3 |
| Example 2 | 3.2 | 22 | 18 | 1.8 |
| Example 3 | 17.5 | 21 | 19 | 1.2 |
| Example 4 | 6.5 | 26 | 22 | 1.7 |
| Example 5 | 13.5 | 25 | 25 | 1.4 |
| Comparative Example 1 | 289.8 | 21 | 30 | 2.5 |
| Comparative Example 2 | 28.0 | 4100 | 111 | 13.2 |
| Comparative Example 3 | 1000< | 28 | 22 | 1.9 |
| Comparative Example 4 | 1000< | 25 | 16 | 2.6 |
| Comparative Example 5 | 1000< | 28 | 26 | 1.7 |

<Evaluation on Results>

From test results shown in Table 1, the following are found.

Since results for the minimum activation energy of "B", "D", "E", "G" and "K" are in the range specified in the present invention and very low values, energy required to withdraw hydrogen of a phenolic hydroxyl group of each of "B", "D", "E", "G" and "K" is very low, liable to produce a radical and high in radical trapping ability. Further, among "B", "D", "E", "G" and "K", "B", "D", "E" and "K" have the structure specified in the present invention.

From test results shown in Table 2, the following are found.

Since results for the octanol/water partition coefficient of "A", "B", "C", "D", "E", "F", "I", "J" and "K" are in the range specified in the present invention so that they are high in hydrophilicity and excellent in compatibility (solubility) with the aqueous phase. From the results of the quinone derivative, which is a structure after trapping a radical, it is found that "A", "B", "D", "E", "I" and "K" have excellent compatibility (solubility) with the aqueous phase. Further, among "A", "B", "D", "E", "I" and "K", "B", "D", "E" and "K" have the structure specified in the present invention.

From test results shown in Table 3, the following are found.

From the results shown in Tables 1 and 2, each of "B", "D", "E" and "K" was selected as the inhibitor of small diameter microparticle production to produce each toner of Examples 1 to 5 for testing. On the other hand, for Comparative examples, "A", "C", "G" and "H" were respectively used to produce toners of Comparative examples 1 to 5 for testing.

In the production method of the toner of Comparative example 2, due to the use of "A" as the inhibitor of small diameter microparticle production and PERBUTYL O as the polymerization initiator, production of by-product small diameter microparticles was relatively inhibited. However, residual amounts of styrene and the ether component were very large, and there was a problem with shelf stability at high temperature. On the other hand, in Comparative example 1, due to the use of the same inhibitor of small diameter microparticle production as Comparative example 2 and TRIGONOX 27 as the polymerization initiator, residual amounts of styrene and the ether component were small. However, production of by-product small diameter microparticles was not sufficiently inhibited.

To the contrary, in the production method of toners of Examples 1 to 5, due to the use of "B", "D", "E" and "K" selected respectively as the inhibitor of small diameter microparticle production and TRIGONOX 27 as the polymerization initiator, production of by-product small diameter microparticles was sufficiently inhibited, and residual amounts of styrene and the ether component were very small. Further, toners having excellent shelf stability at high temperature were obtained.

What is claimed is:

1. A production method of a toner for developing an electrostatic image comprising steps of:

providing a polymerizable monomer composition comprising at least a polymerizable monomer and a colorant;

dispersing the polymerizable monomer composition in an aqueous dispersion medium comprising a dispersion stabilizer to obtain a suspension having droplets of the polymerizable monomer composition dispersed;

adding an inhibitor of small diameter microparticle production from 0.01 to 1 part by weight in the aqueous dispersion medium with respect to the polymerizable monomer of 100 parts by weight after forming droplets of the polymerizable monomer composition, wherein the inhibitor of small diameter microparticle production is provided separately from the polymerizable monomer composition;

performing a suspension polymerization with the aqueous dispersion medium in the presence of a polymerization initiator to obtain colored resin particles;

wherein a minimum reaction activation energy $E_{min}$ of the inhibitor of small diameter microparticle production is 7 kcal/mol or less and an octanol/water partition coefficient logP is 2 or less; and wherein the minimum reaction activation energy $E_{min}$ is a minimum value of a reaction activation energy "E" which is required when a phenylpropane radical represented by the following Formula 1 acts on the inhibitor of small diameter microparticle production so as to withdraw a hydrogen of a phenolic hydroxyl group present in a molecular structure of the inhibitor of small diameter microparticle production followed by production of a radical:

Formula 1:

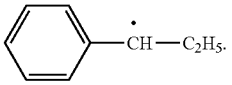

2. The production method of a toner for developing an electrostatic image according to claim 1, wherein the inhibitor of small diameter microparticle production has a structure represented by the following Formula 2, 3 or 4:

Formula 2:

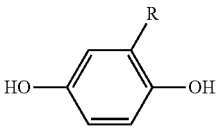

Formula 3:

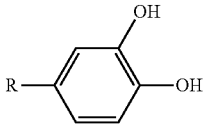

Formula 4:

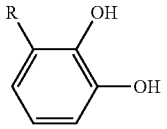

wherein "R" denotes OX, $SO_3X$, $CO_2X$ or $CH{=}CHCO_2X$; and "X" denotes hydrogen or metal.

3. The production method of a toner for developing an electrostatic image according to claim 2, wherein the inhibitor of small diameter microparticle production having the structure represented by the Formula 2, 3 or 4 is oxidized so as to be lead to a quinone derivative having the structure represented by the following Formula 5, 6 or 7 and an octanol-water partition coefficient "logP" of 0.6 or less:

Formula 5:

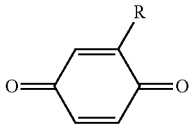

Formula 6:

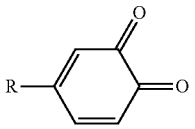

Formula 7:

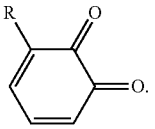

4. The production method of a toner for developing an electrostatic image according to claim 1, wherein pH of the aqueous dispersion medium is from 8 to 11.

5. The production method of a toner for developing an electrostatic image according to claim 1, wherein the polymerization initiator is organic peroxide.

6. The production method of a toner for developing an electrostatic image according to claim 5, wherein the organic peroxide is a peroxyester compound.

7. The production method of a toner for developing an electrostatic image according to claim 6, wherein the peroxyester compound is t-butylperoxy-2-ethylbutanoate.

8. The production method of a toner for developing an electrostatic image according to claim 1, wherein an average number of small diameter microparticles per colored resin particle is 200 or less.

9. The production method of a toner for developing an electrostatic image according to claim 1, wherein the toner for developing an electrostatic image is a toner having positively charging ability.

10. The production method of a toner for developing an electrostatic image according to claim 1, wherein the inhibitor of small diameter microparticle production has a structure represented by the following Formula 2, 3 or 4:

Formula 2:

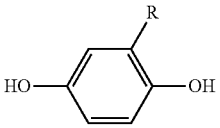

Formula 3:

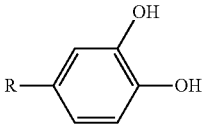

Formula 4:

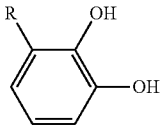

wherein "R" denotes OX or $SO_3X$; and "X" denotes hydrogen or metal.

11. The production method of a toner for developing an electrostatic image according to claim 1, wherein the inhibitor of small diameter microparticle production is added to the polymerizable monomer composition after forming droplets of the polymerizable monomer composition, and before starting the suspension polymerization.

* * * * *